US011136767B2

(12) United States Patent
Förg et al.

(10) Patent No.: US 11,136,767 B2
(45) Date of Patent: Oct. 5, 2021

(54) SEALING STRIP FOR SEALING DRYWALL CONNECTING JOINTS

(71) Applicant: Hilti Aktiengesellschaft, Schaan (LI)

(72) Inventors: Christian Förg, Lamerdingen (DE); Manfred Klein, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/488,295

(22) PCT Filed: Apr. 4, 2018

(86) PCT No.: PCT/EP2018/058532

§ 371 (c)(1),
(2) Date: Aug. 23, 2019

(87) PCT Pub. No.: WO2018/188999

PCT Pub. Date: Oct. 18, 2018

(65) Prior Publication Data

US 2019/0376300 A1 Dec. 12, 2019

(30) Foreign Application Priority Data

Apr. 13, 2017 (EP) ..... 17166404

(51) Int. Cl.
*E04B 1/94* (2006.01)
*E04B 1/68* (2006.01)
(Continued)

(52) U.S. Cl.
CPC ..... *E04F 19/022* (2013.01); *E04B 1/68* (2013.01); *E04B 1/78* (2013.01); *E04B 1/8209* (2013.01);
(Continued)

(58) Field of Classification Search
CPC . E04B 1/948; E04B 1/94; E04B 1/946; E04B 1/947; E04B 2/7411; E04B 1/6812;
(Continued)

(56) References Cited

U.S. PATENT DOCUMENTS 4,130,972 A * 12/1978 Varlonga ..... E04B 2/7411 52/241
4,164,107 A * 8/1979 Kraemling ..... E06B 3/305 52/232
(Continued)

FOREIGN PATENT DOCUMENTS

| | | |
|---|---|---|
| DE | 36 16 896 | 11/1987 |
| EP | 3 056 624 | 8/2016 |
| EP | 3 056 626 | 8/2016 |

OTHER PUBLICATIONS

International Search Report dated Jul. 2, 2018 in PCT/EP2018/058532 with English translation.
Written Opinion dated Jul. 2, 2018 in PCT/EP2018/058532.

*Primary Examiner* — Phi D A
(74) *Attorney, Agent, or Firm* — Grüneberg and Myers PLLC

(57) ABSTRACT

A sealing strip is for sealing drywall connecting joints. The sealing strip has a centre web with two longitudinal edges, wherein along each longitudinal edge, a sealing profile is arranged having a first profile section, which is arranged along the allocated longitudinal edge and has a first thickness in the transverse direction of the centre web. A second profile section adjoins the first profile section, and the second profile section forms the end of the sealing profile that is remote from the centre web and has a second thickness in the transverse direction of the centre web, the second thickness being smaller than the first thickness.

19 Claims, 5 Drawing Sheets

(51) Int. Cl.

| | |
|---|---|
| ***E04B 1/78*** | (2006.01) |
| ***E04F 19/02*** | (2006.01) |
| ***E04B 1/82*** | (2006.01) |
| ***E04B 1/88*** | (2006.01) |
| ***E04B 2/72*** | (2006.01) |

(52) U.S. Cl.
CPC ..... *E04B 1/88* (2013.01); *E04B 1/946* (2013.01); *E04B 1/948* (2013.01); *E04B 2/721* (2013.01); *E04B 1/94* (2013.01)

(58) Field of Classification Search
CPC ..... E04B 1/6813; E04B 1/6815; E04B 1/944; E04B 1/68; E04B 1/78; E04B 1/8209; E04B 1/88; E04B 2/721; E04B 2/82; E04B 2/7453; E04F 19/022
See application file for complete search history.

(56) References Cited

U.S. PATENT DOCUMENTS 4,203,264 A * 5/1980 Kiefer ..... E06B 3/6715 52/1
4,249,353 A * 2/1981 Berry ..... H02G 3/22 52/232
4,430,832 A * 2/1984 Kaiser ..... E04B 2/82 52/238.1
4,899,509 A * 2/1990 Power ..... E04B 2/825 52/238.1
5,913,788 A * 6/1999 Herren ..... E04B 2/825 52/236.7
8,151,526 B2 * 4/2012 Klein ..... E04B 2/7457 52/1
2003/0079425 A1 * 5/2003 Morgan ..... E04B 2/7411 52/232
2011/0247281 A1 10/2011 Pilz et al.
2013/0232902 A1 9/2013 Mayer et al.
2017/0306615 A1 10/2017 Klein et al.
2018/0002917 A1 1/2018 Kleinhans et al.
2018/0010333 A1 1/2018 Foerg et al.
2018/0030727 A1 2/2018 Klein et al.
2018/0030735 A1 2/2018 Klein et al.
2018/0038100 A1 2/2018 Braunmueller et al.
2018/0044913 A1 2/2018 Klein et al.
2018/0111361 A1 4/2018 Ober et al.
2018/0202147 A1 7/2018 Klein et al.

* cited by examiner

SEALING STRIP FOR SEALING DRYWALL CONNECTING JOINTS

This application is a National Stage entry under § 371 of International Application No. PCT/EP2018/058532, filed on Apr. 4, 2018, and which claims the benefit of European Application No. 17166404.8, filed on Apr. 13, 2017.

BACKGROUND OF THE INVENTION

Field of the Invention

The present invention relates to a sealing strip for sealing of connecting joints in drywalls. These are situated, for example, in the region of connection of drywalls to connecting elements, such as inter-story ceilings, floors, massive walls or other load-bearing elements.

Description of Related Art

For fastening of drywalls to connecting elements, channel profiles are generally fastened to the corresponding connecting elements. The channel profile may be part of a studwork. At a well-defined spacing relative to the connecting element, gypsum boards may be attached thereto. It is known that, for reasons of fire-protection capability and for sound insulation, any gap remaining between the gypsum boards and the connecting building parts must be filled with sealing compound. However, this process suffers from some disadvantages. Firstly, it is very work-intensive and therefore costly. Furthermore, sealing requires access to the walls from both sides and can be performed only after the gypsum boards have been mounted. In addition, the method is error-prone, since the user himself or herself must dose the correct quantity of material. The underlying surfaces must be adhesive. If they are not, the danger of detachment of the sealing compound exists. If the sealing compound is overloaded, cracks may develop. Moreover, the correct spacing of the gypsum boards relative to the connecting element must be adjusted with additional aids.

Sealing strips are known that can be mounted between a ceiling rail in the form of a channel profile and a connecting element during the mounting of drywalls. These sealing strips are designed substantially as channel profiles. The legs of the U-shaped sealing strip have a rectangular cross section with constant thickness. However, these sealing strips are unable to eliminate all disadvantages described in the foregoing. An aid is likewise necessary for adjustment of the spacing of the gypsum boards relative to the connecting building part. Moreover, further disadvantages exist. The gypsum boards are mounted on the legs of the sealing strip, whereby the sealing strip is greatly compressed in the region under the boards. If the legs of the sealing strip are too thick, the gypsum board may become curved, with a tendency to break. The maximum possible leg thickness of the sealing strip is therefore limited. This has the disadvantage that the insulating material present in the gap to be sealed is also limited, which in turn adversely affects the fire-protection and sound-insulation properties. In addition, due to the pressure exerted by the gypsum board, the original leg thickness is also reduced in the region of the gap.

BRIEF SUMMARY OF THE INVENTION

It is therefore one object of the present invention to specify an improved sealing strip for sealing of connecting joints in drywalls.

The object is solved by a sealing strip for sealing of connecting joints in drywalls that is provided with a central web having two longitudinal rims, wherein a sealing profile is disposed along each longitudinal rim. The sealing profile has a first profile portion, which is disposed along the associated longitudinal rim and in transverse direction of the central web has a first thickness, and a second profile portion, adjoining the first profile portion, which forms the end of the sealing profile remote from the central web and in transverse direction of the central web has a second thickness, wherein the second thickness is smaller than the first thickness.

DETAILED DESCRIPTION OF THE INVENTION

Figure 1:
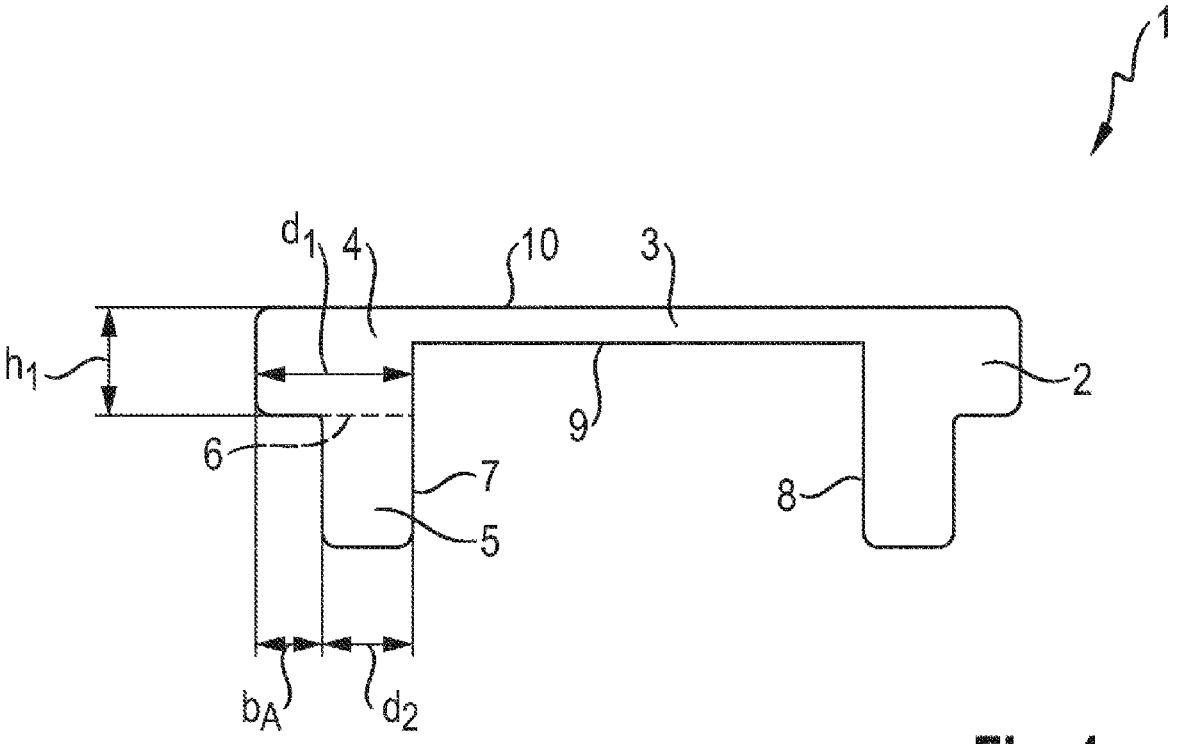
FIG. 1 schematically shows a cross section of an inventive sealing strip according to a first embodiment.

One advantage of the inventive sealing strip is that the sealing profile does not have to be compressed as greatly in the region of the second profile portion. In this way, the danger that a board will become curved or broken is minimized. In contrast, by virtue of the greater thickness of the first profile in the region of the gap to be sealed, adequate material is present to achieve the desired fire-protection and sound-insulation properties.

The sealing strip may be designed as an elongated profile.

Furthermore, the sealing profiles may be disposed symmetrically relative to a central plane of the sealing strip. The plane of symmetry is aligned perpendicularly relative to the central web and it extends along a longitudinal direction of the sealing strip.

The sealing strip is preferably made in one piece.

In an alternative embodiment of the invention, the sealing strip is made in multiple pieces. In particular, the central web and the part of the first profile portion that corresponds to the second thickness $d_2$, and the second profile portion corresponding to the second thickness $d_2$, is formed in one piece from one material, preferably as a U-shaped sealing strip, and wherein the part of the first profile portion that corresponds to the thickness $d_1$-$d_2$ is formed from another material. In this embodiment, the central web and the part of the first profile portion that corresponds to the second thickness $d_2$, and the second profile portion corresponding to the second thickness $d_2$, is precompressed, so that the material of the part of the first profile portion that corresponds to the thickness $d_1$-$d_2$ consists of foam or is formed as a foam part, in order to permit absorption of movement of the sealing profile. In a particularly preferred embodiment, the central web and the part of the first profile portion that corresponds to the second thickness $d_2$, and the second profile portion corresponding to the second thickness $d_2$, is formed in one piece from one material, which is not thicker than less than 5 mm, preferably less than 3 mm.

According to one embodiment of the invention, the first and/or the second profile portion may have a substantially rectangular cross section.

Furthermore, the first profile portion may merge into the second profile portion via a wedge-shaped intermediate portion. Due to this thickness difference and the intermediate portion, it is ensured that, if the sealing profile is squeezed only in the region of the second profile portion, the first profile portion is not also compressed to the effect that it would acquire a smaller thickness, whereby the connecting joint would become more difficult to seal.

According to a further embodiment, the first and/or second profile portion may have an outer side that is convex (e.g. bulbous or semicircular) or undulating.

A concave portion, which merges into the second profile portion, may adjoin the portion of the first profile portion that defines the convex or semicircular outer side.

According to a preferred embodiment, the transition from the first to the second profile portion forms a shoulder. This shoulder is dependent on the different thicknesses of the first and second profile portions. A height of the shoulder is therefore given by the difference between the first thickness and the second thickness. The height of the shoulder extends in a direction transverse to the longitudinal direction of the sealing strip. Here also the shoulder is able to ensure that the first profile portion is compressed less greatly when the second profile portion is squeezed, so that the connecting joint is filled more completely by the sealing strip.

In the case that both the first and second profile portions are rectangular, the shoulder has the form of a step. However, depending on geometry of the profile portions, the shoulder may also have an undulating shape or be formed as a chamfer.

The shoulder serves as an aid in the positioning of structural elements for drywalls, for example of gypsum boards.

A sealing strip having such a shoulder has the advantage that no further aids are needed for positioning of gypsum boards on drywalls. The boards merely have to be aligned on the shoulder. The boards may be aligned particularly accurately when the shoulder has the form of a step, wherein a corner of a gypsum board may be aligned accurately on a corner of the step. For other geometries, the user may easily vary the position of the gypsum board without impacting the appearance or the function. On the whole, boards can be mounted simply and securely without losses of sealing properties. In particular, gypsum boards, for example, may be mounted without measuring work at an optimum joint spacing relative to a connecting element, for example a ceiling. The optimum joint spacing corresponds substantially to a height of the first profile portion. The height of the first profile portion extends in the direction perpendicular to the central web.

According to a preferred embodiment, the sealing strip is U-shaped on the whole in cross section, wherein the legs of the U merge into the central web and are formed by the two profile portions. Due to the U-shaped geometry of the sealing strip, it can be mounted particularly rapidly and easily. For example, the sealing strip may be laid over a likewise U-shaped building beam, onto which the drywall boards are bolted in place, wherein the dimensions of the sealing strip can be adapted to those of the beam. The U-shaped beam may then be mounted on further structural elements of the building, wherein the sealing strip may be clamped between the U-shaped beam and the further structural element. Thus the sealing strip is fixed in a well-defined position. Thereby mounting of further building parts may be facilitated.

An end face of the sealing strip is preferably formed by an upper side of the central web and by an upper side of the first profile portion, wherein the upper sides lie in one plane. Thereby the sealing strip is able to function particularly well on plane connecting building parts during mounting. By virtue of the flexible design of the sealing strip, however, it is also able to adapt to irregularities.

In an alternative embodiment, the end face of the sealing strip is formed by an upper side of the central web and by an upper side of the first profile portion, wherein the upper side of the central web may have a recess, which preferably extends centrally in the sealing strip.

The region of the central web located between the two sealing profiles, or more accurately between the two points of attachment of the central web to the sealing profiles, defines a support region, which consists only of the central web. This support region is dimensioned such that it corresponds approximately to the width of the web of the channel profile. Hereby the installation and especially the positioning of the sealing strip on the web of the channel profile is facilitated. Preferably, the support region of the inventive sealing strip has a width in the range of approximately 30 mm to approximately 300 mm, preferably in the range of approximately 50 mm to 250 mm, and more preferably in the range of approximately 90 mm to 155 mm. Particularly preferably, the support region of the inventive sealing strip has a width of 67 mm for a 2½ inch (64 mm) rail, of 95 mm for a 3⅝ inch (92 mm) rail, of 105 mm for a 4 inch (102 mm) rail, of 155 mm for a 6 inch (152 mm) rail, of 206 mm for an 8 inch (203 mm) rail or of 257 mm for a 10 inch (254 mm) rail. Most preferably, the support region of the inventive sealing strip has a width of 95 mm for a 3⅝ inch (92 mm) rail or of 155 mm for a 6 inch (152 mm) rail.

In order to obtain various profile dimensions, especially various widths of the support region, the central web of the inventive sealing strip may further have at least one width-extending element. Preferably, the width-extending element exists in the form of a loop. The width-extending element consists of a deformable material, of a plastic film, of a fabric, of a nonwoven or the like, preferably of a plastic film.

This width-extending element is fastened on the upper side or underside of the central web, in such a way that a loop 50 (e.g., see FIG. 7) is produced. Fastening is achieved by stitching, adhesive bonding or welding, especially by welding. The dimension of the loop is designed such that, after the two sealing-strip halves have been pulled apart, for example by means of complete separation of a perforation 55 (e.g., see FIG. 7) of the central web, the desired width for an alternative profile is obtained. Thus a second profile dimension may be obtained by a separation step and so, for example, the sealing strip can be used simultaneously for a 3⅝ inch (92 mm) or 6 inch (152 mm) rail.

Furthermore, the inventive sealing strip may have one or more additional width-extending elements in the form of loops. These additional width-extending elements may be obtained in that the loops of the at least one central web are subdivided still further one or more times with a weld seam, so that several profile widths may be covered with one product by appropriate cutting apart of the seam or seams.

In particular, the common channel profiles having profile widths of 2½ inch (64 mm), 3⅝ inch (92 mm), 4 inch (102 mm), 6 inch (152 mm), 8 inch (203 mm) and 10 inch (254 mm) may be covered by the one or by the several width-extending elements. Hereby the installation and especially the positioning of the sealing strip on the web of the channel profile is facilitated. To facilitate selection of the desired width of the sealing strip for a particular profile, the width-extending elements may be provided with markings for the particular profile sizes. Due to the flexibility of the width-extending element, however, it is also possible to cover other profile widths of channel profiles of a drywall studwork with the inventive sealing strip and to seal the joint.

In an alternative embodiment of the sealing strip, the central web has a perforation. The perforation of the sealing strip preferably extends in the middle of the central web, i.e. in longitudinal direction of the sealing strip. The perforation permits easy separation (tearing apart) or alternatively pulling apart of the two sealing-strip halves. By tearing apart without the use of tools, two separate sealing-strip halves can be easily obtained, each of which has a sealing profile and which may be used with the aid of a gluing means, such as a separate adhesive tape or adhesive spray, for example, and either for one-sided sealing or for broader channel profiles, especially channel profiles with profile widths of more than 10 inch (254 mm). It is also possible that the sealing strip is provided prior to separation with self-adhesive means, so that two half-strips, which may be mounted immediately without further aids, are obtained after it has been torn apart. The sealing-strip halves are therefore universally usable for different profile dimensions.

The inner sides of the legs of the U may be designed to be plane. The inner sides are formed by inside faces of the profile portions. In particular, one face of the first profile portion and one face of the second profile portion are able together to form the inner side of a leg.

The inner sides of the legs extend in particular perpendicular to an inner side of the central web.

In an alternative embodiment, the inner sides of the legs extend at an obtuse or at an acute angle relative to the inner side of the central web. In particular, a geometry of the sealing strip may be adapted, depending on application situation, to particular profiles. By virtue of the flexible formation of the sealing strip, however, it is also able to adapt to many geometric conditions without change of shape of the sealing strip.

According to a further alternative embodiment, the inner sides of the legs may be designed to be convex or concave. As an example, a concave design is suitable for the sealing of tubular profiles.

The central web is preferably designed to be plane. By virtue of the flexibility of the sealing strip, and since the central web is relatively thin, it may also be adapted without problems to curved profiles, and so a curved structure of the central web is actually not required. Nevertheless, such embodiments are in no case to be ruled out.

In particular, the central web may also have a recess. Preferably, a perforation or seam, with the help of which the sealing strip may be separated into two halves if desired, extends in this recess. The recess preferably extends over a width of the support region of the central web that is shorter than the total width of the support region of the central web, and so it permits, on the one hand, savings of material during manufacture of the sealing strip and, on the other hand, easier separation of the sealing strip if desired. The central web may be provided with the recess either on the upper side or on the underside.

Both the sealing profiles and the central web may be compressible.

Furthermore, the sealing strip may be designed to be flexible on the whole.

The sealing strip may be provided with a foam or be designed as a foam part. In particular, the sealing strip may be provided with an open-celled foam. Thereby high absorption of movement of the sealing profile is possible.

The sealing strip may be provided with a material that is impermeable to air, noise-absorbing or soundproof, fire-resistant, impervious to smoke and/or thermally insulating, or it may consist of such a material. For protection against damage during storage or transportation of the sealing strip, the sealing strip may be coated with a tear-resistant film.

Figure 2:
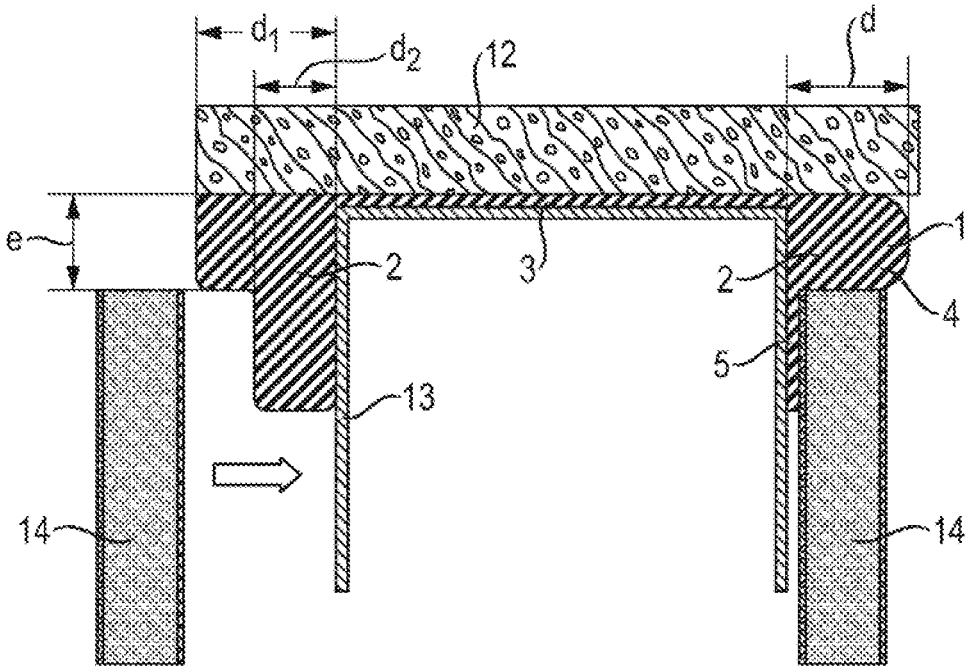
FIG. 2 shows a schematic diagram of the mounting of a drywall with a sealing strip according to the first embodiment.
Figure 3:
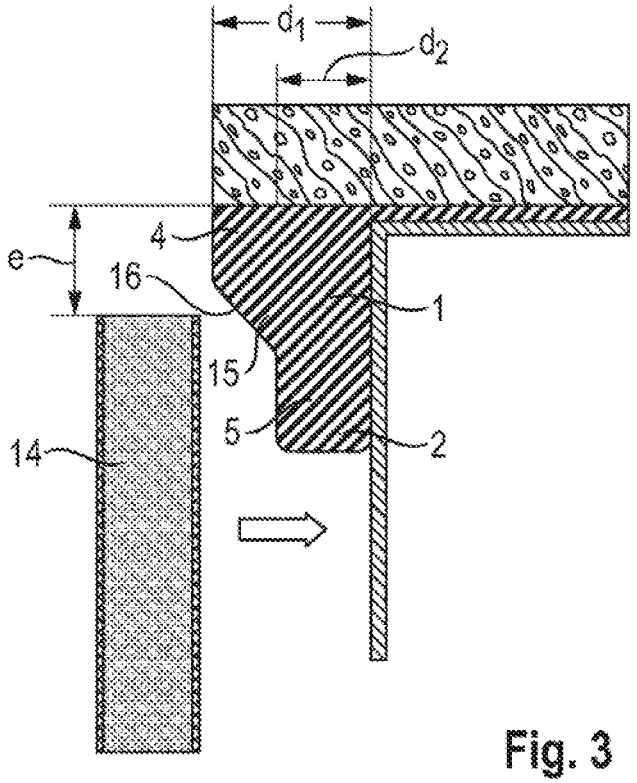
FIG. 3 shows a schematic diagram of the mounting of a drywall with a sealing strip according to a further alternative embodiment.
Figure 4:
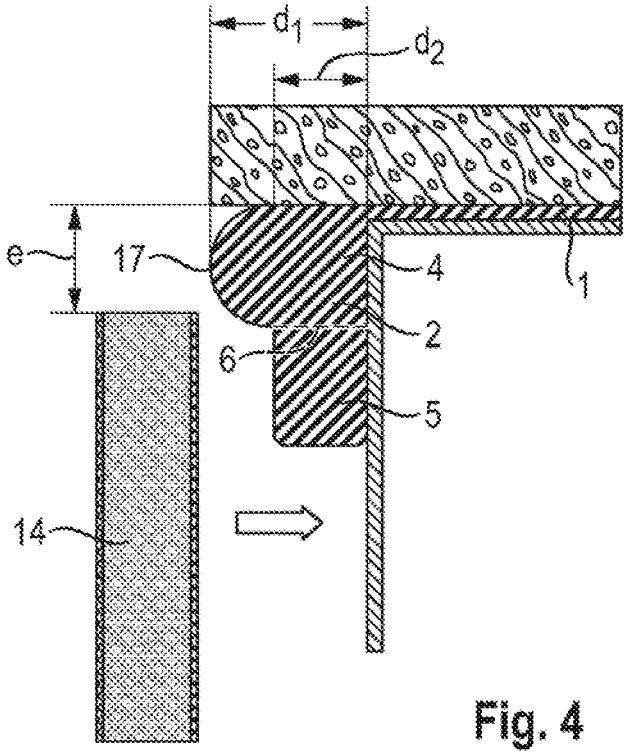
FIG. 4 shows a schematic diagram of the mounting of a drywall with a sealing strip according to another further alternative embodiment.
Figure 5:
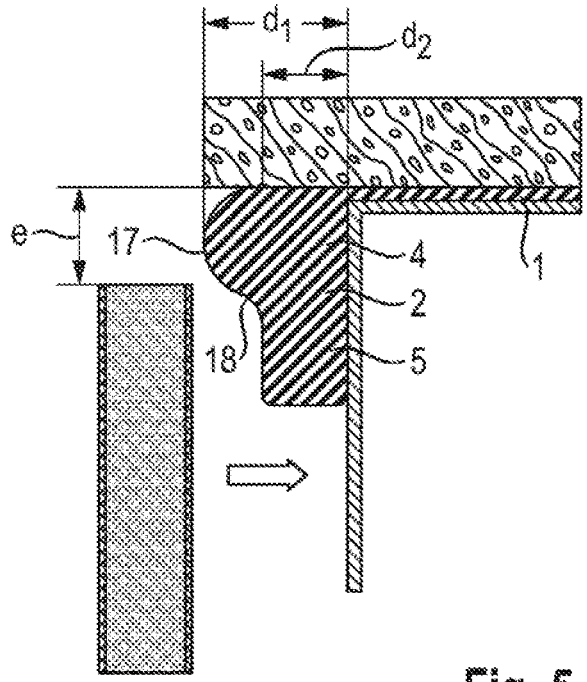
FIG. 5 shows a schematic diagram of the mounting of a drywall with a sealing strip according to yet another further alternative embodiment.
Figure 6:
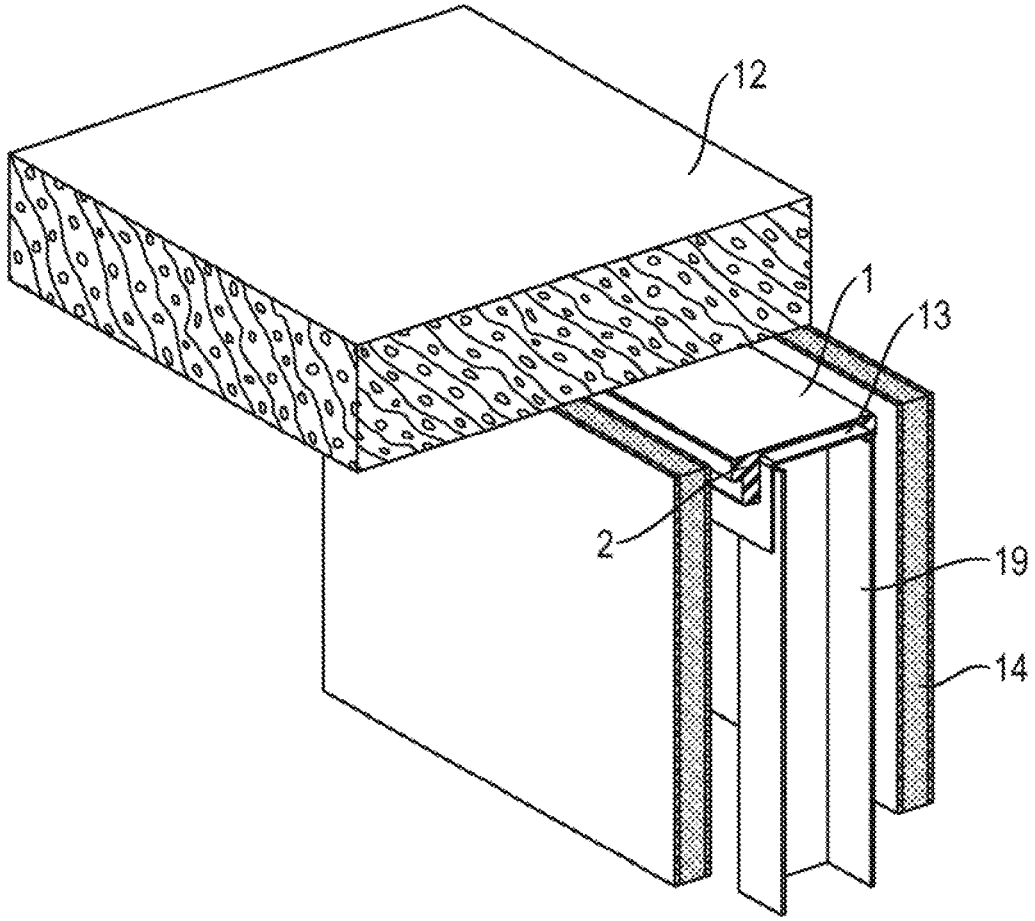
FIG. 6 shows a perspective sectional diagram of a drywall during mounting with an inventive sealing strip.
Figure 7:
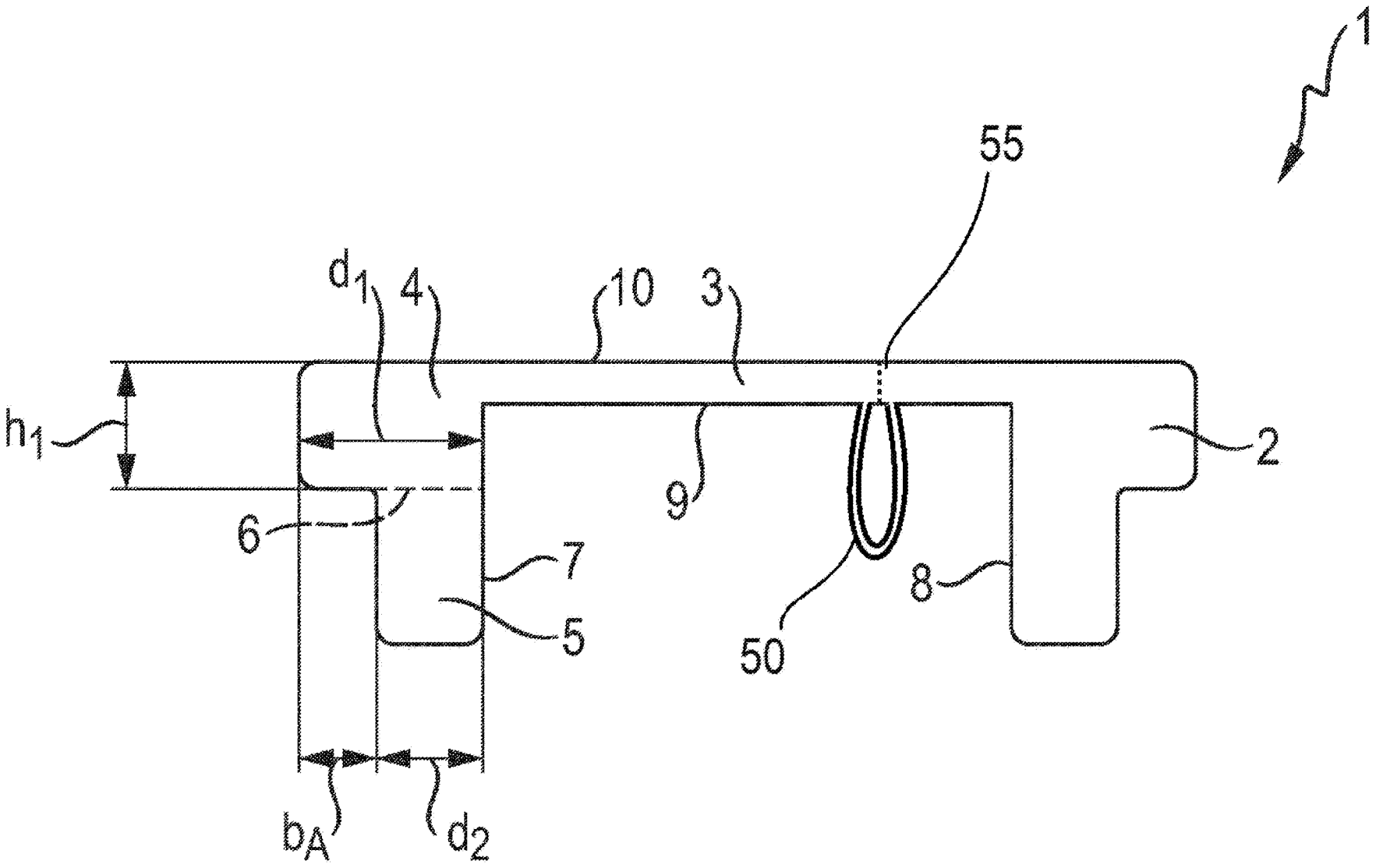
FIG. 7 shows an additional embodiment of the inventive sealing strip.

Further features and advantages of the invention will become apparent from the description hereinafter and from the attached drawings, to which reference is made. In the drawings:

FIG. 1 schematically shows a cross section of an inventive sealing strip according to a first embodiment, FIG. 2 shows a schematic diagram of the mounting of a drywall with a sealing strip according to the first embodiment, FIGS. 3 to 5 respectively show a schematic diagram of the mounting of a drywall with a sealing strip according to further alternative embodiments, FIG. 6 shows a perspective sectional diagram of a drywall during mounting with an inventive sealing strip, and FIG. 7 shows an additional embodiment of the inventive sealing strip.

FIG. 1 schematically shows a cross section through a sealing strip 1 according to a first embodiment. In FIG. 1, sealing strip 1 is illustrated in an uncompressed condition. Sealing strip 1 has two symmetrically disposed lateral sealing profiles 2 and a central web 3. Central web 3 is designed as a flat web, which joins the two sealing profiles 2 to one another. Sealing strip 1 is U-shaped on the whole in cross section. The lateral legs of the U merge into central web 3 and are formed by the two profile portions 4, 5. Sealing profiles 2 are respectively disposed along a longitudinal rim of central web 3. Central web 3 has the function of keeping sealing profiles 2 at a well-defined spacing relative to one another. In addition, central web 3 may contribute to the sealing function of sealing strip 1.

Each sealing profile 2 has respectively a first profile portion 4 and a second profile portion 5. For better understanding, first profile portion 4 and second profile portion 5 are separated from one another in FIG. 1 by a dashed line 6. However, this is provided merely for illustration; profile portions 4, 5 merge into one another as a single piece. Second profile portion 5 adjoins first profile portion 4 and forms an end of sealing profile 2 remote from central web 3.

In the embodiment of sealing strip 1 shown in FIG. 1, both first profile portion 4 and second profile portion 5 have a substantially rectangular cross section.

First profile portion 4 has a first thickness $d_1$. Second profile portion 5 has a second thickness $d_2$. The first and the second thickness extend in the direction of a cross-sectional extent of sealing strip 1, i.e. in a transverse direction of central web 3. The longitudinal direction of central web 3 extends in the plane of the drawing.

Second thickness $d_2$ is smaller than first thickness $d_1$. Thereby sealing profile 2 has the form of a step. In particular, the transition from first profile portion 4 to second profile portion 5 forms a shoulder. The shoulder has a width $b_A$. Width $b_A$ extends in the direction of a transverse extent of sealing strip 1 and is equal to the difference between first thickness $d_1$ and second thickness $d_2$. The step shape of the sealing profiles is used, for example, for alignment of gypsum boards, which will be explained in more detail in connection with the following figures.

Inner sides 7, 8 of the legs of the U are respectively designed to be plane and are formed by inside faces of profile portions 4, 5. Inner sides 7, 8 of the legs extend perpendicular to an inner side 9 of central web 3.

Sealing strip 1 has an end face 10 opposite inner side 9. End face 10 is formed by an upper side of central web 3 and by an upper side of first profile portion 4. The upper sides of central web 3 and of first profile portion 4 lie in one plane.

Sealing strip 1 is designed to be flexible on the whole. Thereby the individual sealing profiles 2 are compressible. Sealing strip 1 is manufactured by foaming. In particular, the sealing strip may be provided with a material that is impermeable to air, noise-absorbing or soundproof, fire-resistant, impervious to smoke and/or thermally insulating. For example, sealing strip 1 may be provided with a polyurethane foam.

FIG. 2 schematically illustrates the mounting of a drywall with the sealing strip 1 according to FIG. 1.

Sealing strip 1 is pre-mounted between a connecting element 12 and a channel profile 13 of the building. Channel profile 13 may be part of a load-bearing structure of the building. Connecting element 12 may be, for example, a room ceiling or a mounting element for fastening the drywall to an inter-story ceiling, a floor or a wall.

Sealing strip 1 is mounted in such a way that central web 3 is disposed between connecting element 12 and channel profile 13. In a mounted condition of sealing strip 1, sealing profiles 2 are disposed laterally relative to channel profile 13.

In the diagram according to FIG. 2, a right board 14 but not yet the left board has already been bolted in place, and so sealing profile 2 is illustrated as compressed on the right side and as uncompressed on the left side.

Due to the shoulder having width $b_A$, especially due to its step shape, sealing strip 1 may be used as a mounting aid for the mounting of board 14, especially a gypsum board. This board 14 is positioned in such a way that an edge of board 14 is aligned against the shoulder of sealing profile 2. Thereby a well-defined spacing e of board 14 relative to connecting element 12 is obtained. A spacing e, which is also referred to as the joint width, corresponds substantially to a height $h_1$ of first profile portion 4. Height $h_1$ of first profile portion 4 extends in a direction perpendicular to central web 3.

During bolting of board 14 in place onto the load-bearing structure, sealing strip 1 is compressed in the region of second profile portion 5. Thereby a region between board 14 and channel profile 13 is sealed. For this purpose, thickness $d_2$ of second profile portion 5 is chosen such that board 14 does not become curved or broken while it is being bolted in place.

Thickness $d_1$ of first profile portion 4 is chosen such that sufficient sealing of the gap between 14 and connecting element 12 is ensured.

Thereby adequate thermal insulation, sound absorption and fire protection may be achieved.

During mounting of board 14, a cross-sectional change may occur in an upper region of sealing strip 1 due to the compression of sealing strip 1 in the region of second profile portion 5. In particular, the thickness $d_1$ of first profile portion 4 may be reduced to a value d. This occurs because, while board 14 is being bolted in place, the material of sealing strip 1 is compressed, especially in the region of second profile portion 5, and thus the adjoining material in first profile portion 4 is also compressed. It is therefore recommended that the thickness $d_2$ of second profile 5 be kept as small as possible, since the cross-sectional change in first profile portion 4 becomes less the smaller $d_2$ is.

FIG. 3 shows an alternative embodiment of a sealing strip 1 in a mounted position between a connecting element 12 and a channel profile 13 before board 14 is bolted in place. Sealing strip 1 is designed in a manner similar to that of sealing strip 1 described in connection with FIGS. 1 and 2, but sealing profiles 2 according to this embodiment have an alternative cross section. First profile portion 4 merges into second profile portion 5 via a wedge-shaped intermediate portion 15. Thereby a chamfer 16 is obtained between first profile portion 4 and second profile portion 5.

FIGS. 4 and 5 show further alternative embodiments of a sealing strip 1.

Sealing strip 1 according to FIG. 4 is designed in a manner similar to that of sealing strip 1 described in connection with FIGS. 1 and 2, but first profile portion 4 in the embodiment according to FIG. 4 has an outer side 17 that is convex, especially semicircular in cross section.

Sealing strip 1 according to FIG. 5 is designed in a manner similar to that of the sealing strip described in connection with FIG. 4. In sealing strip 1 shown in FIG. 5, however, a concave portion 18, which merges into second profile portion 5, adjoins the portion that defines convex outer side 17. In particular, sealing profile 2 has an undulating outer side in one portion.

In the variants described in FIGS. 3 to 5, the user may easily vary joint width e without impacting the function or the final appearance.

FIG. 6 shows a perspective diagram of a drywall during mounting with a sealing strip 1. Sealing strip 1 is pushed onto channel profile 13, which is to be fastened, together with a beam 19, onto connecting element 12. Thus sealing strip 1 is fixed in a well-defined position and, in fact, in such a way that sealing profiles 2 bear flush on the channel profile. Gypsum boards 14 are aligned against a shoulder of sealing profiles 2, as described hereinabove.

The foam part of sealing strip 1 may be surrounded on all sides, for example by a film-like outer skin.

The invention claimed is:

1. A sealing strip for sealing of connecting joints in drywalls, comprising:

a central web, which has two longitudinal rims, a first sealing profile, which is disposed along a first one of the longitudinal rims, and a second sealing profile which is disposed along a second one of the longitudinal rims, the first sealing profile comprises:

a first profile portion, which is connected to the central web and disposed along the first one of the longitudinal rims and which extends in a perpendicular direction below a bottom surface of the central web and has a first thickness, a second profile portion, which is adjoining the first profile portion and which corresponds to an end of the sealing profile and extends in the perpendicular direction under a bottom surface of the central web, wherein the second profile portion has a second thickness smaller than the first thickness and an outer surface of the first profile portion extends farther away from the central web than an outer surface of the second profile portion to create a space for accommodating a building structure in an installed state, the space offset from overlapping the central web and the first profile portion overlapping a first side of the building structure and the second profile portion adjacent to and compressed by a second side of the building structure when the building structure is in the space in the installed state, wherein compression of the second profile portion by the second outer side causes the second profile to change from the second thickness to a third thickness smaller than the second thickness, and wherein the second sealing profile comprises:

a third profile portion, which is connected to the central web and disposed along the second one of the longitudinal rims and which extends in the perpendicular direction below the bottom surface of the central web and has a fourth thickness equal to or different than the first thickness, and a fourth profile portion, which is adjoining the third profile portion and which corresponds to an end of the sealing profile and extends in the perpendicular direction under the bottom surface of the central web, wherein the fourth profile portion has a fifth thickness, equal to or different than the second thickness, and smaller than the fourth thickness, and an outer surface of the third profile portion extends farther away from the central web than an outer surface of the fourth profile portion to create a space for accommodating a building structure in an installed state, the space offset from overlapping the central web and the third profile portion overlapping a first side of the building structure and the fourth profile portion adjacent to and compressed by a second side of the building structure when the building structure is in the space in the installed state, wherein compression of the fourth profile portion by the second outer side causes the fourth profile to change from the fifth thickness to a sixth thickness smaller than the fifth thickness, and wherein the central web, the first sealing profile, and the second sealing profile are joined to form a U-shaped cross section, and wherein legs of the U merge into the central web and are formed by the first and second sealing profiles.

2. The sealing strip according to claim 1, wherein the first profile portion and/or the second profile portion have a substantially rectangular cross section.

3. The sealing strip according to claim 1, wherein the sealing strip has an end face, which is formed by an upper side of the central web and by an upper side of the first profile portion, and wherein the upper sides lie in one plane.

4. The sealing strip according to claim 1, wherein the sealing strip has an end face, which is formed by an upper side of the central web and by an upper side of the first profile portion, wherein the upper side of the central web has a recess.

5. The sealing strip according to claim 1, wherein inner sides of the legs of the U are respectively designed to be planar and are formed by inside faces of the first profile portion and the second profile portion.

6. The sealing strip according to claim 5, wherein the inner sides of the legs extend perpendicular to an inner side of the central web.

7. The sealing strip according to claim 1, wherein the first and second profile portions are compressible.

8. The sealing strip according to claim 1, wherein the sealing strip is flexible.

9. The sealing strip according to claim 1, wherein the sealing strip is designed as a foam part.

10. The sealing strip according to claim 1, wherein the sealing strip is provided with a material that is impermeable to air, noise-absorbing, soundproof, fire-resistant, impervious to smoke, and/or thermally insulating.

11. The sealing strip according to claim 1, wherein the central web has a perforation.

12. The sealing strip according to claim 4, wherein the recess extends centrally in the sealing strip.

13. The sealing strip according to claim 1, wherein the central web has at least one width-extending element comprising a material selected from the group consisting of a deformable material, a plastic film, a fabric, and a nonwoven.

14. The sealing strip according to claim 1, wherein the first sealing profile and the second sealing profile have different cross-sectional shapes.

15. The sealing strip according to claim 1, further comprising:

a slanted portion that merges a transition area between the first profile portion and the second profile portion.

16. The sealing strip according to claim 1, wherein an angle of an angled portion in the transition area merging the first profile portion and the second profile portion is 90°.

17. The sealing strip according to claim 15, wherein the slanted portion comprises a chamfer that merges the transition area between the first profile portion and the second profile portion.

18. The sealing strip according to claim 15, wherein the slanted portion comprises a convex or undulating outer side that merges the transition area between the first profile portion and the second profile portion.

19. The sealing strip according to claim 18, wherein the slanted portion comprises a concave portion, which merges into the second profile portion, and adjoins the first profile portion that defines the convex outer side.

* * * * *